US006405016B1

(12) United States Patent
Fournier et al.

(10) Patent No.: US 6,405,016 B1
(45) Date of Patent: Jun. 11, 2002

(54) DEVELOPER MATERIAL COLLECTION BOTTLE

(75) Inventors: John C Fournier, Depew; Gerald L Kelly, III, Byron; John F Crichton, Honeoye Falls; Thomas J Benedetto, Fairport, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 801 days.

(21) Appl. No.: 08/560,507

(22) Filed: Nov. 17, 1995

(51) Int. Cl.[7] ..... G03G 21/12
(52) U.S. Cl. ..... 399/360; 174/51; 361/215
(58) Field of Search ..... 355/260, 298; 361/212, 214, 215, 250, 220; 174/51; 222/DIG. 1; 399/120, 123, 262, 360; 220/694, 476, 480

(56) References Cited

U.S. PATENT DOCUMENTS

| | | | | |
|---|---|---|---|---|
| 3,615,415 A | | 10/1971 | Gramza | |
| 3,917,397 A | | 11/1975 | Tanaka et al. | 355/15 |
| 3,965,524 A | * | 6/1976 | Kurita et al. | 355/298 |
| 4,502,780 A | | 3/1985 | Suzuki et al. | 355/15 |
| 4,875,081 A | | 10/1989 | Goffe et al. | 355/303 |
| 5,260,755 A | | 11/1993 | Imazumi | 355/298 |
| 5,378,526 A | * | 1/1995 | Murata | 428/214 |

FOREIGN PATENT DOCUMENTS

| | | | |
|---|---|---|---|
| DE | 4412206 | * | 8/1995 |
| JP | 56059276 | * | 5/1981 |
| JP | 59-74082 | * | 4/1984 |
| JP | 61163363 | * | 7/1986 |
| JP | 62047684 | * | 3/1987 |
| JP | 04166975 | * | 6/1992 |

* cited by examiner

*Primary Examiner*—Robert Beatty
(74) *Attorney, Agent, or Firm*—Lawrence P. Kessler

(57) ABSTRACT

A bottle for collecting untransferred developer material and debris cleaned from a dielectric member of a reproduction apparatus. The collection bottle is a container having an opening adapted to receive untransferred developer material and debris therethrough for storage within the container. The container is made of a conductive material. The conductive material is a carbon-doped plastic having a volume resistivity of less than $10_8$ ombs cms with the carbon dopent being approximately 15–20% by weight. The container is coupled to electrical ground via an electrical tap, whereby static charge build-up is substantially prevented.

2 Claims, 3 Drawing Sheets

DEVELOPER MATERIAL COLLECTION BOTTLE

BACKGROUND OF THE INVENTION

The present invention relates in general to bottles for collecting untransferred developer material cleaned from reproduction apparatus dielectric members, and more particularly to an untransferred developer material collection bottle which is made of a conductive material and grounded to prevent static charge build-up.

In typical commercial reproduction apparatus such as electrostatographic copier/duplicators, printers, or the like, a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser assembly at a downstream location. At the fuser assembly, the image is fixed to the receiver member by heat and/or pressure to form a permanent reproduction on such receiver member. Substantially simultaneously, the dielectric member is cleaned of untransferred marking particles and debris to enable the dielectric member to be readied for reuse.

In the cleaning process for the dielectric member, the untransferred marking particles and debris are collected and removed from the dielectric member, and accumulated in a collection bottle for later disposal in an environmentally friendly manner. The collection bottle has typically been made of a plastic material such as polyethylene for example. However, static charge associated with untransferred marking particles tends to build up on the surface of plastic bottles. At a high enough charge level, the static charge can arc to the nearest conductive surface. This is known to cause electrical interference problems which can adversely effect normal operation of reproduction apparatus. Furthermore, the build up of static charge may present a potential shock hazard, such as to the reproduction apparatus service personnel for example.

SUMMARY OF THE INVENTION

In view of the foregoing discussion, this invention is directed to a bottle for collecting untransferred developer material and debris cleaned from a dielectric member of a reproduction apparatus, whereby static charge build-up is substantially prevented. The collection bottle is a container having an opening adapted to receive untransferred developer material and debris therethrough for storage within the container. The container is made of a conductive material. The conductive material is a carbon-doped plastic having a volume resistivity of less than 10ohms cms with the carbon dopent being approximately 15–20% by weight. The container is coupled to electrical ground.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
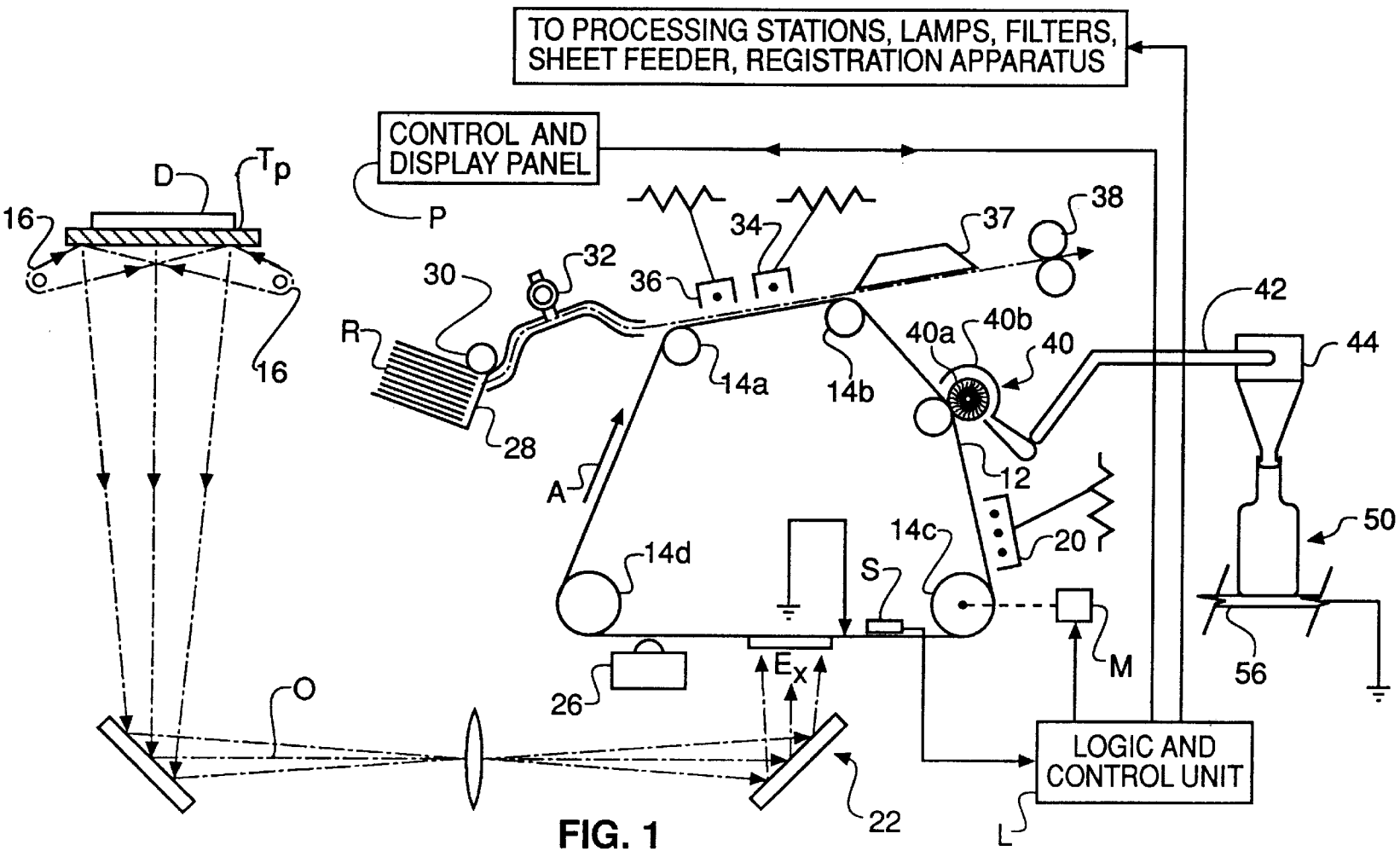
FIG. 1 is side elevational view of a reproduction apparatus, partly in cross-section and with portions broken away to facilitate viewing, including the grounded conductive collection bottle according to this invention.

Referring now to the accompanying drawings, FIG. 1 shows schematically an exemplary reproduction apparatus of the electrostatographic type, designated generally by the numeral 10. The reproduction apparatus 10 includes a dielectric member such as a grounded photoconductive web 12, for example of the type disclosed in U.S. Pat. No. 3,615,414 (issued Oct. 26, 1971, in the name of Light). The web 12, which has sequentially spaced image receiving areas, is supported by rollers 14*a*–14*d* for travel about a closed loop path. A motor 110 is operatively coupled to one of the rollers (e.g., roller 14*c*) to move the web about the closed loop path, in the direction of arrow A, through various electrographic processing stations under the control of a logic and control unit L.

The logic and control unit L includes, for example, a microprocessor based central processing unit receiving various input and timing signals. The input signal may be, for example, signals representative of the status of the various processing stations respectively, while the timing signals may be produced by a sensor S detecting movement of the web 12 about its closed loop path. Based on such signals and programs supplied by software control algorithms associated with the central processing unit, the logic and control unit L provides signals for controlling the operation of the various functions of the reproduction apparatus for carrying out the reproduction process. The production of suitable programs for commercially available central processing units is a conventional skill well understood in the art. The particular details of any such programs would, of course, depend upon the architecture of the designated central processing unit.

For the typical electrophotographic process carried out by the exemplary reproduction apparatus 10, the web 12 is moved by the motor M about the closed loop path. Following a particular image receiving area of the web, such area is brought into association with a primary charger 20 which places a uniform electrostatic charge on the web. As such area of the web 12 moves into association with an exposure station $E_x$, a document D (located information side down on a transparent platen $T_p$) is illuminated by flash lamps 16 to generate a reflected light image of the information contained in the document. The reflected light image is directed along the optical path O to the exposure station $E_x$ by a mirror and lens arrangement 22 to expose the uniformly charged image receiving area of the web 12. Such exposure selectively alters the charge to form an electrostatic latent image charge pattern corresponding to the information contained in the document. Of course, the exposure could alternatively be accomplished by electronically produced images formed by LEDs (light emitting diodes) or fiber optic arrays, or by raster, laser or flying spot scanners directed onto the charged image receiving area of an appropriate dielectric member.

After exposure, the area of the web 12 bearing the latent image charge pattern moves into association with a development station 26. The development station 26 includes a magnetic brush developer mechanism containing pigmented marking particles which exhibit a triboelectric charge of opposite polarity to the electrostatic latent image charge pattern on the web 12. The magnetic brush developer mechanism brings the marking particles into association with the latent image charge pattern where the particles are attracted to the web 12 to develop the latent image charge pattern and form a developed image on the web.

The developed image on the web 12 is then brought into association with a transfer station 36 including, for example, a corona transfer charger. Of course, other mechanisms for effecting transfer, such as an electrically biased transfer roller for example, are suitable for use herewith. As the area of the web bearing the developed image is moving toward the transfer station 36, a receiver member R is transported into association therewith. The reproduction apparatus 10 has at least one receiver member supply hopper 28 containing a stack of receiver members, such as cut sheets of plain bond paper or transparency material. A feed mechanism 30, such as an oscillating vacuum feeder, is located in juxtaposition with the hopper 28 so as to feed the topmost receiver member from the stack at a predetermined time into a transport path intersecting the closed loop path of the web 12 immediately upstream of the transfer station 36. A registration apparatus 32 in the path squares up a receiver member transported along the path relative to the path, and provides timing control over the receiver member so that the receiver member arrives at the web 12 in accurate register with the area of the web bearing the developed image.

The corona transfer charger of the transfer station 36 is connected to a DC or biased AC electrical potential source (not shown) to apply a charge to the receiver member as it travels with the image bearing area of the web 12 past the transfer station. The applied charge is of the opposite polarity as the charge on the marking particles and of substantially greater absolute value. Accordingly, the marking particles P forming the developed image are attracted to the receiver member R, at a linear rate, from the web 12 and adhere to the receiver member in an image wise fashion as the receiver member and web travel past the corona transfer charger.

Downstream of the transfer station 36, an AC powered detack charger 34, if required, applies a charge to the receiver member to substantially neutralize the attractive charge holding the receiver member in contact with the web 12. Thus the receiver member can be separated from the web and transported by transport apparatus 37 to a fusing device 38 where the transferred marking particle image on the receiver member is fixed to the receiver member by, for example, heat and/or pressure. Thereafter, the receiver member is delivered to an output tray, or other well known finishing device (such as a stapler or sorter for example), for operator retrieval. As the receiver member is separated from the web 12, the web continues about its closed loop path into association with a cleaning apparatus 40 where any residual marking particles and/or debris (e.g., paper dust) attracted to the web are removed. This particular area of the web is then returned to association with the primary charger 14 so that such area can be reused in forming another reproduction when desired.

The cleaning mechanism 40 includes, for example, a fur brush 40*a* rotatable within a housing 40*b*. A conduit 42 connects the housing 40*b* to a cyclone separator 44. Of course other cleaning mechanisms are suitable for use with this invention. As is well known, in operation of the cleaning mechanism 40, an air stream generated by the cyclone separator 44 creates a vacuum to draw residual marking particles and debris swept from the web 12 by the rotating fur brush 40*a* through the housing 40*b* and conduit 42 into the cyclone separator. In the cyclone separator, the marking particles and debris are separated from the air stream and fall within the cyclone separator to be deposited for accumulation in a chamber, such as the collection bottle 50 according to this invention.

As noted above, static charge present on the material (marking particles and debris) accumulated in the collection bottle 50 has a tendency to build up on the bottle surfaces. Therefore, the collection bottle 50, according to this invention, is formed of a conductive material with a volume resistivity in the range of less than $10^8$ ohm cms. For example, in the preferred embodiment, the conductive material for the collection bottle 50 is a carbon- doped plastic, such as polyethylene, polypropylene, polyallomer, or a copolymer of these resins, where the carbon makes up between 15–20% by weight of the material, and the volume resistivity is in the range of $10^3$–$10^6$ ohm cms.

The collection bottle 50 is suitably connected to electrical ground so as to prevent static charge build-up. In the embodiment shown in FIGS. 1–3, an electrical tap is formed by providing the bottle with an integral tab 52. For example, the tab 52, formed when the bottle is formed, extends substantially radially from the bottom of the bottle (see FIGS. 2 and 3). The tab 52 has a hole 52*a* for receiving a screw thread 54. The screw thread 54 is, in turn, attached to a grounded support plate 56. As such the plate 56 serves to support the collection bottle 50, and provide an electrical ground path from the bottle for static charge on the surfaces of the bottle. Thus, any electrical interference which would adversely effect normal operation of the reproduction apparatus 10, and potential shock hazard to the reproduction apparatus service personnel, caused by arcing is substantially eliminated.

Figure 2:
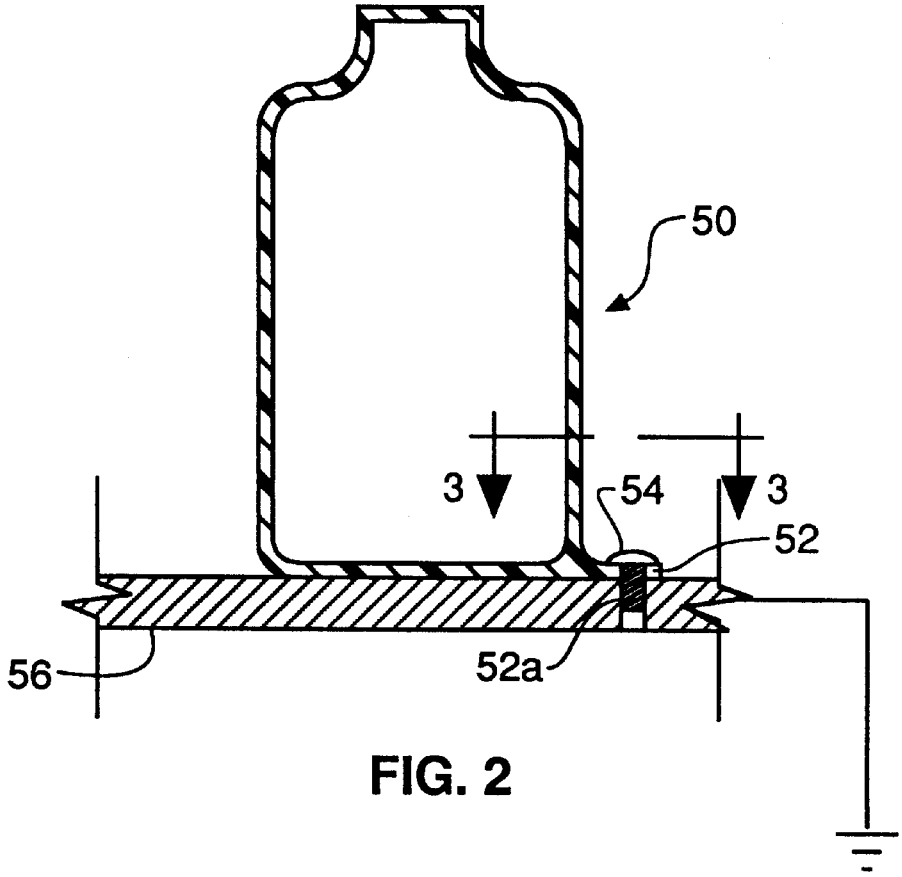
FIG. 2 is a front elevational view, partially in cross-section and on an enlarged scale, of the grounded conductive collection bottle according to this invention.
Figure 3:
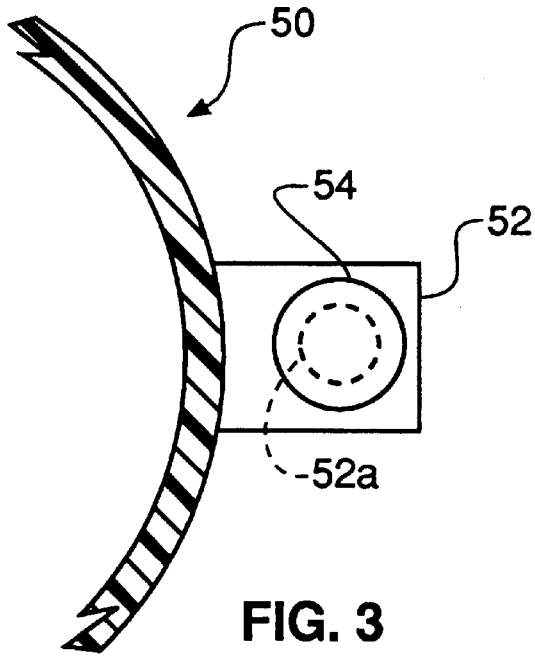
FIG. 3 is a top plan view of a cross-section of the grounded conductive collection bottle according to this invention, taken along the lines 3—3 of FIG. 2.
Figure 4:
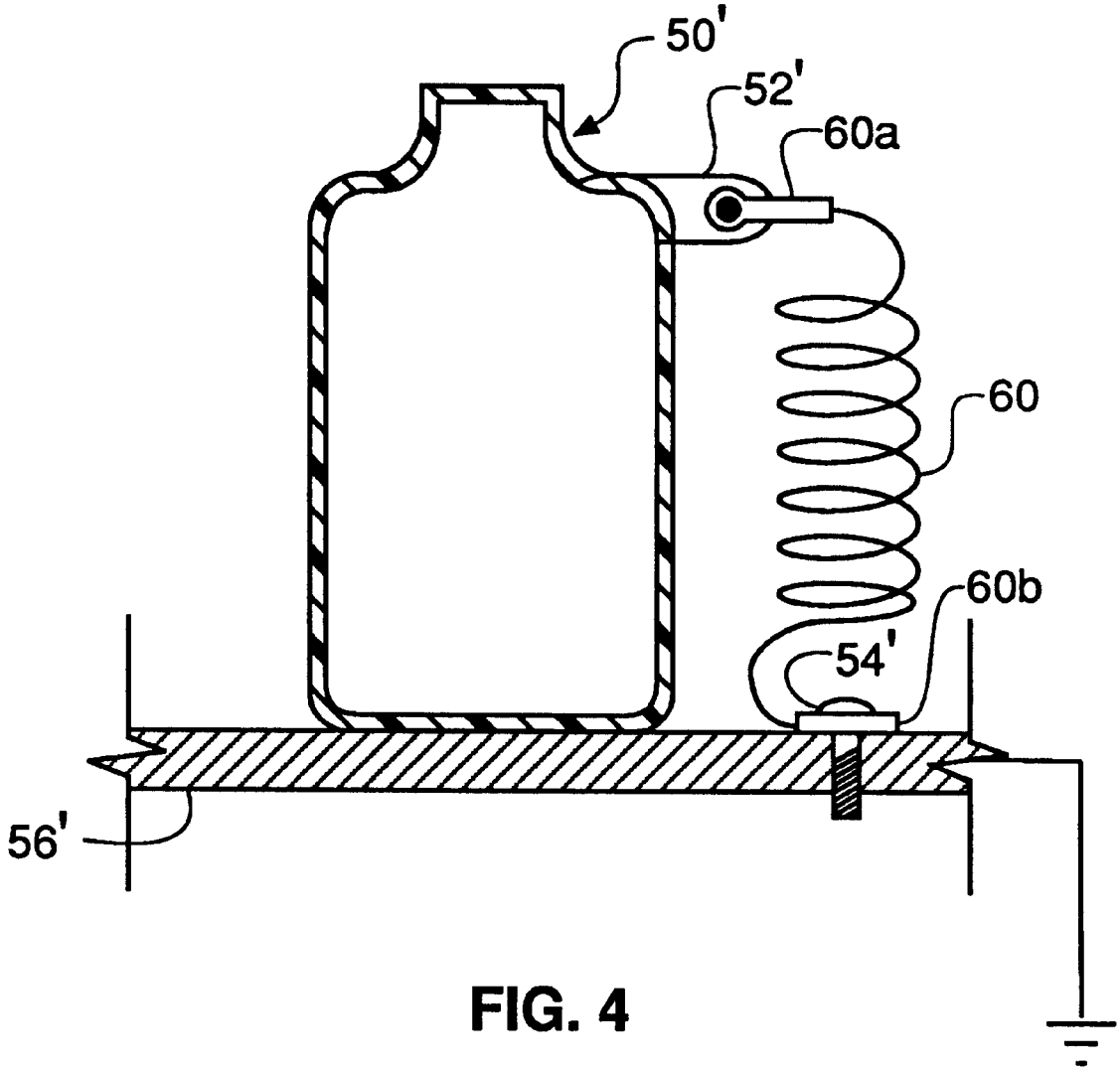
FIG. 4 is a front elevational view, similar to FIG. 2, partially in cross-section and on an enlarged scale, of an alternate embodiment of the grounded conductive collection bottle according to this invention.

An alternate embodiment for the collection bottle 50 of FIGS. 1–3 is shown in FIG. 4, and designated by the numeral 50'. The collection bottle 50' is suitably connected to electrical ground, so as to prevent static charge build-up, by providing the bottle with an integral tab 52'. For example, the tab 52', formed when the bottle is formed, extends substantially radially from the top of the bottle. A screw thread 54' is attached to a grounded support plate 56'. An electrically conductive, extensible cable 60 is provided having electrically conductive connectors 60*a* and 60*b* coupled to the respective ends of the cable. The screw thread 54' is then electrically coupled to the tab 52' by the extensible cable 60, with connector 60*a* attached to tab 52' and end 60*b* attached to the screw thread 54'.

With the described connection of the plate 56' to the collection bottle 50', the plate serves to support the collection bottle, and provide an electrical ground path from the bottle for static charge on the surfaces of the bottle. Thus, any electrical interference which would adversely effect normal operation of the reproduction apparatus 10, and potential shock hazard to the reproduction apparatus service personnel, caused by arcing is substantially eliminated. Moreover, since the ground path between the collection bottle 50' and the support plate 56' is provided by the extensible cable 60, the collection bottle can be moved for emptying the contents therein without disconnecting the collection bottle from electrical ground, further ensuring the safety of service personnel.

The invention has been described in detail with particular reference to preferred embodiments thereof, but it will be understood that variations and modifications can be effected within the spirit and scope of the invention as set forth in the claims.

What is claimed is:

1. A bottle for collecting untransferred developer material and debris cleaned from a dielectric member of a reproduction apparatus, said collection bottle comprising:

a container having an opening adapted to receive untransferred developer material and debris therethrough for storage within said container, said container being made of a conductive material, said conductive material being a carbon-doped plastic having a volume resistivity of less than $10^8$ ohm cms with said carbon dopent being approximately 15–20% by weight; and an electrical tap including a tab integrally formed with said container and connected to electrical ground, whereby static charge build-up is substantially prevented.

2. The collection bottle of claim 1 further including an electrically conductive, extensible cable connected at one end to said tab and at the other end to said electrical ground.

* * * * *